United States Patent [19]

Dorsey

[11] Patent Number: 4,543,695

[45] **Date of Patent: * Oct. 1, 1985**

[54] JEWELRY CLUTCH

[76] Inventor: Edmund Dorsey, 455 Meschanticut Valley Pkwy., Cranston, R.I. 02920

[ * ] Notice: The portion of the term of this patent subsequent to Sep. 20, 2000 has been disclaimed.

[21] Appl. No.: 509,340

[22] Filed: Jun. 30, 1983

Related U.S. Application Data

[63] Continuation-in-part of Ser. No. 327,887, Dec. 7, 1981, Pat. No. 4,404,713.

[51] Int. Cl.[4] ..... A44B 17/00

[52] U.S. Cl. ..... 24/662; 24/671; 279/1 Q; 279/3; 403/225; 403/372

[58] Field of Search ..... 24/104, 106, 108, 116 A, 24/155 SD, 573, 588, 662, 664, 667, 671, 672; 411/16–18, 44, 63, 360, 512; 403/225, 226, 372; 279/1 Q, 3, 24; 248/362, 363

[56] References Cited

U.S. PATENT DOCUMENTS

| | | | |
|---|---|---|---|
| 1,323,532 | 12/1919 | Hoar | 24/588 X |
| 2,274,417 | 2/1942 | Katcher | 403/226 |
| 2,546,312 | 3/1951 | Larymore | 279/1 Q X |
| 2,638,761 | 5/1953 | Henry | 279/1 Q X |
| 2,832,245 | 4/1958 | Burrows | 279/1 Q X |
| 2,931,661 | 4/1960 | Harris | 279/1 Q X |
| 3,282,602 | 11/1966 | Willingshofer et al. | 403/226 X |
| 3,687,465 | 8/1972 | Grime et al. | 277/177 X |
| 4,246,679 | 1/1981 | Monett | 24/108 X |
| 4,387,488 | 6/1983 | Kanzaka | 24/108 X |
| 4,404,713 | 9/1983 | Dorsey | 24/662 |

FOREIGN PATENT DOCUMENTS

| | | | |
|---|---|---|---|
| 1327302 | 4/1963 | France | 411/44 |
| 64986 | 5/1913 | Switzerland | 24/155 SD |
| 266724 | 2/1950 | Switzerland | 403/225 |
| 237440 | 6/1969 | U.S.S.R. | 279/1 Q |

*Primary Examiner*—William E. Lyddane
*Assistant Examiner*—James R. Brittain
*Attorney, Agent, or Firm*—Barlow & Barlow, Ltd.

[57] ABSTRACT

A clutch is disclosed consisting of two parts, the first part being a tubular shell closed at one end, the shell having therein a resilient female clutch member that is held in position by lips on the open end of the shell. A male member is provided which is adapted to be received within the resilient member. The resilient member within the shell is cylindrical of a longitudinal dimension less than the space within the shell and of an outside diameter less than the inside diameter of the shell. The male member is made of a size so that the sum of its diameter plus the wall thickness of the resilient clutch member is greater than the inside diameter of the tubular shell, so as to create an airtight joint when the male member is inserted within the resilient member, but yet permitting air to escape around the outside of the resilient member and retarded ony when disengagement is attempted, at which time the resilient clutch member will seal against the lip of the tubular shell.

3 Claims, 11 Drawing Figures

JEWELRY CLUTCH

This application is a continuation-in-part of my application Ser. No. 327,887, filed Dec. 7, 1981, now U.S. Pat. No. 4,404,713.

Clutches or jewelry clasps are commonly made up with a female member and a complimentary male member. One common form of clutch is what is known as a box clutch which is used for fastening the ends of necklaces together and is of a type exemplified, as for example, in U.S. Pat. No. 2,986,792. There are also a plurality of pin stem clutches utilizing resilient gripping material, as for example, as disclosed in U.S. Pat. No. 3,945,089, and necklace clutches with resilient inserts as seen in U.S. Pat. No. 3,066,501. Where resilient material is used inside of a body to grip a male member, the resilient material is firmly held within the body and is deformed by the male member. The holding power of a device of this nature is therefore dependent solely on the elasticity of the resilient piece.

Accordingly, it is an object of this invention to provide an improved clutch construction which is based on the utilization of male and female members, and a resilient clutch member retained in a cavity in such a way that when withdrawal is attempted, a partial vacuum is created that develops considerable resistance to removal of the male member.

According to this invention the clutch is formed of two parts, one being a tubular shell which is closed at one end so as to form in effect an open cavity in which a resilient tubular clutch member is retained. The resilient tubular clutch is specifically formed in such a way that its outside diameter is less than the inside diameter of the tubular shell cavity; and further, the resilient tubular clutch member has a longitudinal dimension less than the longitudinal dimension of the shell cavity, so that in effect, the tubular clutch is free to slide within the tubular shell and accordingly must be maintained therein by the provision of a lip at the mouth of the open cavity. Cooperating with the tubular shell is a stud which has a diameter larger than the inner diameter of the clutch member and is, of course, adapted to be inserted and withdrawn from the female clutch member. The sizing of the stud is such that the resilient clutch member will expand toward the wall of the shell and will allow the release of displaced air as the stud member is pushed further inwardly. When the stud is attempted to be withdrawn, the resilient clutch member will slide toward the lip at the open mouth of the cavity in the tubular shell and the seal against the lip so that in effect, a vacuum is created in the cavity as further withdrawal is attempted. A clutch member therefore does not depend upon the resilience of the material that is used as a clutch member, but by the sealing thereof of the stud into the shell so that as with drawal is attempted, a vacuum is created.

More specifically, the present invention is directed to a clutch having a tubular shell that is closed at one end so as to define an open cavity. Within the tubular shell, a resilient stretchable tubular clutch member having a through-bore and an outer tranverse dimension smaller than the inner transverse dimension of the cavity, is placed in the cavity. A second part consisting of a stud of tranverse dimension larger than the inner transverse dimension of the resilient clutch member is provided, and this is adapted to be inserted and withdrawn from the clutch member with the external and internal surfaces respectively of the stud and clutch member in sealing relationship to each other. As a result of the insertion of the stud member, the resilient clutch member expands in the shell during the insertion of the stud, and yet allows release of the displaced air from the shell, the shell having a peripheral lip means at its open end of the cavity and being imperforate so that when the stud is withdrawn, the clutch member will seal against the lip and a partial vacuum will result which will resist disengagement of the stud from the tubular shell.

The invention and its practice will be further described in relation to a jewelry clutch embodying the invention and illustrated in the accompanying drawings, in which.

Figure 1:
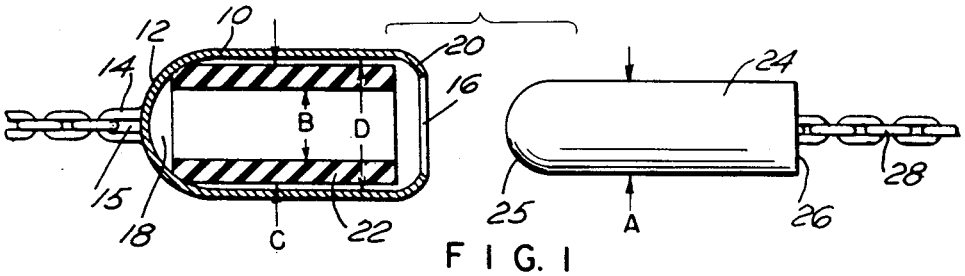
FIG. 1 is a detached sectional view showing the two-part clutch of the invention.

The clutch of this invention includes a tubular shell 10 which is closed at one end 12 to which an ear 14 is affixed having an aperture 15 therein. The tubular shell 10 has a mouth as at 16 which opens into a cavity 18 and, at the mouth of the cavity, an inturned lip 20 is formed by rolling the edge of the shell inwardly.

Within cavity 18 there is received a resilient tubular clutch member 22, and it will be noted by referring to the drawing that the clutch member 22 is of a longitudinal dimension less than the longitudinal dimension of the cavity 18, and is of a diameter less than the inner diameter of the cavity 18.

Cooperating with the tubular member 10 is a stud 24 which has a blunt nose 25 and a rearward portion 26 to which a chain 28 may be soldered or otherwise affixed. The stud can take a variety of forms, as for example, it can be a hollow tubular portion into which the chain may be soldered, or it may be a solid piece. The dimension "A" of the stud, which is the diameter thereof, is greater than the inner diameter "B" of the resilient member 22. Further, the outer diameter "C" of the resilient member 22 is less than the inner diameter "D" of the tubular shell 10.

Figure 2:
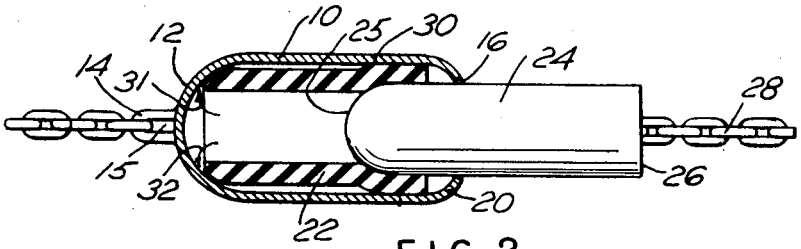
FIG. 2 is a sectional view showing a first stage of insertion of a stud into the clutch.

Referring now to FIG. 2, it will be seen that the stud 24 has been inserted into the mouth 16 of the tubular shell and the resilient member has been expanded so as to slightly contact the inner wall of the cavity 18 as at 30. As the stud progresses inwardly, the displaced air will exhaust as seen by the arrows 31, 32 out along the periphery of the resilient member 22 and will pass out through the mouth 16. When the stud 24 is completely inserted into the tubular shell, the resilient member will have been expanded substantially against the inner wall of the cavity 18 and, as withdrawal is attempted in the direction as seen by the arrow 34, the resilient member 22 will move to the right as seen in the drawing to seal itself against the lip 20. Further withdrawal of the stud will be inhibited by the fact that a vacuum builds up within the cavity 18, there being little possibility of air entering the cavity to equalize the pressure therein, and accordingly, the amount of pull that is necessary on the stud is increased. By way of example, if the dimension "A" is 0.100 inch, then dimension "B" is 0.078 inch, plus or minus 0.004; and the dimension "D" is 0.150 inch. It has been found that it will be necessary to use at least 18 ounces of pull before the stud will release. This is the condition when the stud is fully inserted into the resilient clutch member which had a longitudinal dimension of 0.750 inch. To further understand the increase in the amount of pull which is caused by the partial vacuum that is developed, if one inserted the stud 24 0.200 inch, test have revealed that it takes 18 ounces of pull before the stud will break loose. It will accordingly be recognized that by increasing the length of the resilient member 22, and, of course, the length of the cavity 18, you can increase the holding power. Similarly, the inverse would be true.

Figure 3:
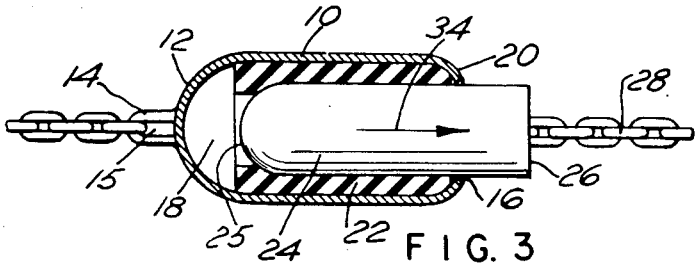
FIG. 3 is a sectional view showing the stud fully inserted with a force being applied thereto as shown by the arrow attempting to pull the two parts apart.

It should further be recognized that when the resilient member 22 compresses as the stud is being inserted therein, that it does not compress linearly so that while in the example given the wall thickness of the resilient member 22 was approximately 0.027 inch and the addition of the figures indicate that a fully inserted structure as seen in FIG. 3 of the drawings would appear to indicate that the stud 24 plus the resilient member 22 would tightly engage the inner wall of the cavity 18. This is not indeed so, due to the longitudinal deformation of the resilient member 22 and the restricted cellular compression of the member within the shell which effectively thins out the wall of the member 22.

Figure 4:
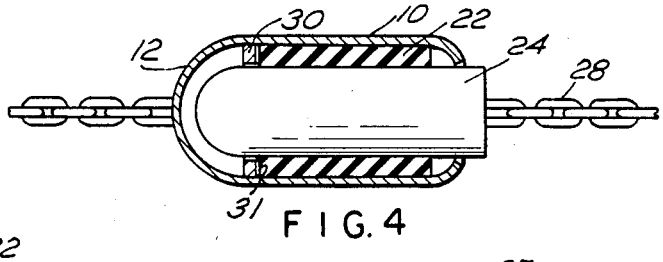
FIG. 4 is a sectional view similar to FIG. 3 showing a first alternate embodiment.

Referring now to FIG. 4, there is shown a clutch with a tubular shell 10, a resilient clutch member 22, and a stud 24, all of which are identical to those similarly numbered elements as shown in the first embodiment. There has been added, however, a washer 30 which is seen in plan view in FIG. 5, which washer is provided with a plurality of radially extending grooves 31, which grooves face the resilient clutch member 22 and retain the resilient clutch member in a more positive position, particularly when the stud is being inserted therein. For example, it has been found on certain occasions that the resilient clutch member 22 will tend to press itself into tight engagement in the curved closed end 12, inhibiting the ability of trapped air to exhaust between the outer wall of the resilient member and the inner wall of the tubular shell. With the addition of the washer 30, this action is prevented, and the resilient member 22 will butt up against the washer 30 and by the provision of the grooves 31, air will now be permitted to exhaust radially outward to pass between the outer wall of the resilient clutch member 22 and the inner wall of the tubular shell 10.

Figure 6:
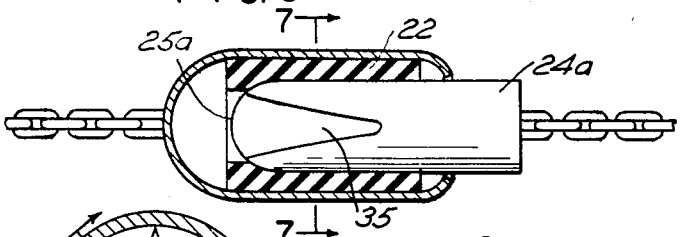
FIG. 6 is a sectional view of a second additional embodiment, similar to the illustration of FIG. 3.
Figure 7:
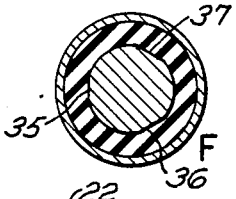
FIG. 7 is a sectional view taken on lines 7—7 of FIG. 6.

Referring now to FIG. 6, there is shown a second alternate embodiment of the clutch in which the stud **24*a* is provided with a modified shape. By referring to FIG. 7 it will be seen that there are three flats 35, 36 and 37 which are cut into the nose of the stud 24*a* at an angle to the axial extent of the stud so that in effect there is a deeper cut as the nose 25*a* than where it meets the outer periphery of the stud 24*a*. In all other respects, the clutch is similar to the disclosed embodiment of FIGS. 1–3, and with this particular arrangement, a faster and easier insert into the resilient clutch 22** can be had.

Figure 8:
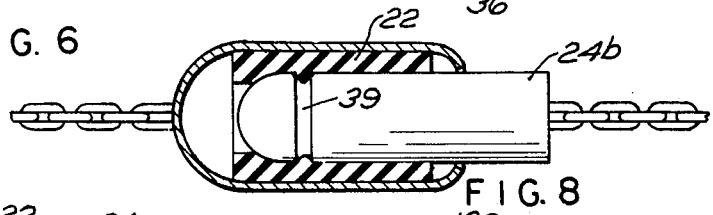
FIG. 8 is a sectional view of a third additional embodiment, shown in the same position as FIG. 3.

Referring now to FIG. 8, the same basic arrangement of the clutch is provided, and again the stud **24*b* has a modified structure. In this case, the stud 24*b* is provided with a groove 39 which has slightly rounded edges. When the stud of this embodiment is inserted into the resilient clutch member 22, the resilient material will tend to enter the groove 39 and provide a greater grip when the stud 24*b*** is inserted fully as seen in the drawing. Withdrawal is enhanced by increased vacuum seal of the stud in the resilient member.

Figure 9:
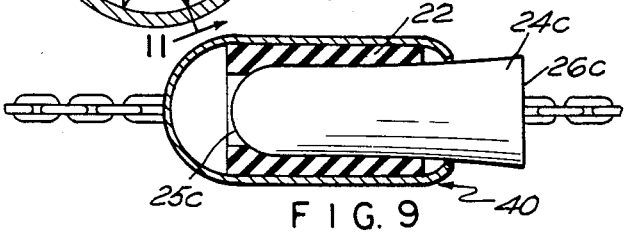
FIG. 9 is a sectional view of a fourth additional embodiment, shown in the same position as FIG. 3.

Referring now to FIG. 9, a still further stud configuration is illustrated where the stud **24*c* is provided with a tapered outline which begins substantially cylindrical at the blunt nose 25*c* and increases in diameter toward the end 26*c*. The result of this configuration is to squeeze the resilient member 22 to a great extent, particularly in the region as designated generally 40 where the diameter of the stud is greater. This arrangement also increased the holding power. If all dimensions are maintained constant for the tubular shell and the resilient clutch member, and if the stud 24 has a nominal diameter in each of the embodiments that is equal, which in the embodiment of FIG. 9 would be near the blunt end 25*c*, then the relative holding power, or the highest amount of pull necessary to separate the parts of the various embodiments, will be found in the embodiment of FIG. 9, followed closely by the embodiment of FIG. 8 and then the embodiments of FIGS. 1 through 3, 4 and 11, which are substantially equal, the embodiment of FIG. 6** being the easiest to pull apart.

Figure 5:
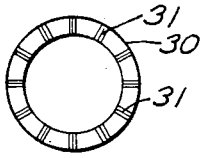
FIG. 5 is a plan view of a washer used in the construction of FIG. 4.
Figure 10:
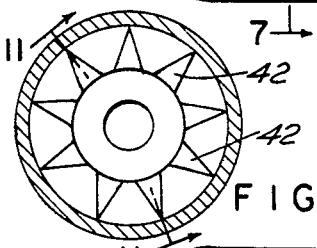
FIG. 10 is a sectional view taken through an end portion of a fifth alternate embodiment.
Figure 11:
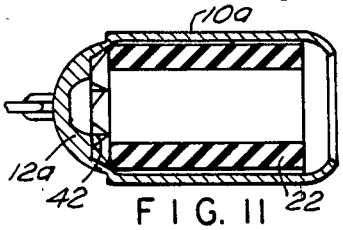
FIG. 11 is a sectional view taken substantially on line 11—11 of FIG. 10, showing the fifth alternate embodiment without the stud inserted therein, the stud utilizing any one of the prior strud constructions.

Referring now to FIGS. 10 and 11, a modified form of shell, particularly for use with the standard stud 24, has been illustrated. Essentially the embodiments of FIGS. 10 and 11 is a modification of the basic philosophy of the embodiment of FIGS. 4 and 5. To this end, the tubular shell **10*a* has been formed slightly differently by striking the rounded end 12*a* with a tool which creates a series of depressions 42 that are illustrated as being somewhat in a starburst design with the points of the depressions 42 extending radially outward substantially to the inner wall of the shell 10*a*. The resilient member 22 when forced against the depressions, will not find a tight seat; but the depressions will permit the escape of air as the stud is inserted, allowing air to pass radially outward and around the outer wall of the resilient member as described in connection with the other embodiments. In effect, therefore, with merely an additional operation, the shell can be formed with radially outward grooves giving the same effect as the radially outward extending grooves on the washer 30 as seen in the embodiments of FIGS. 4 and 5**.

I claim:

1. A clutch comprising a tubular shell closed at one end to define an open cavity, a resilient stretchable tubular clutch member having a through bore and an outer transverse dimension smaller than the inner transverse dimension of the cavity loosely retained in the cavity, a stud of a tranverse dimension larger than the inner transverse dimension of the clutch member and adapted to be inserted and withdrawn from the clutch member with the external and internal surfaces, respectively, of said stud and clutch member in sealing relation to each other, whereby the resilient clutch member expands in said shell during insertion of said stud, yet allows release of displaced air from said shell, said shell having peripheral lip means at the open end of the cavity and being imperforate except for said open end, means at the inner end of the cavity providing a passageway for air from the bore of the tubular clutch member to the wall of said shell, whereby, as the stud is withdrawn, the clutch member seals against the lip means and a partial vacuum occurs thereby resisting disengagement.

2. A clutch as in claim 1 wherein said means at the inner end of the cavity is a washer having an open center and a face having radially extending grooves, the face of said washer bearing against the inner end of said resilient tubular clutch member.

3. A clutch as in claim 1 wherein said means at the inner end of the cavity are a plurality of radially extending grooves at the closed end of the tubular shell against which the resilient clutch member bears when the stud is inserted therein.

* * * * *